US009388781B2

(12) United States Patent
Stein et al.

(10) Patent No.: US 9,388,781 B2
(45) Date of Patent: Jul. 12, 2016

(54) FUEL ACCUMULATOR BLOCK FOR TESTING HIGH-PRESSURE COMPONENTS OF FUEL INJECTION SYSTEMS

(75) Inventors: Ralf Stein, Kirchheim/Teck (DE); Reinhard Hoss, Plochingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 368 days.

(21) Appl. No.: 13/821,909

(22) PCT Filed: Jul. 20, 2011

(86) PCT No.: PCT/EP2011/062433

§ 371 (c)(1),
(2), (4) Date: May 15, 2013

(87) PCT Pub. No.: WO2012/031813

PCT Pub. Date: Mar. 15, 2012

(65) Prior Publication Data

US 2013/0220275 A1 Aug. 29, 2013

(30) Foreign Application Priority Data

Sep. 10, 2010 (DE) ..... 10 2010 040 541

(51) Int. Cl.
*F02M 59/44* (2006.01)
*F02M 53/00* (2006.01)
*F02M 65/00* (2006.01)

(52) U.S. Cl.
CPC ..... *F02M 59/44* (2013.01); *F02M 53/00* (2013.01); *F02M 65/00* (2013.01); *F02M 65/001* (2013.01); *F02M 65/002* (2013.01)

(58) Field of Classification Search
CPC ... F02M 65/001; F02M 65/008; F02M 65/00; F02M 65/002; F02M 59/44
USPC ..... 123/444–448; 73/114.38–114.42, 40, 73/168; 137/47–57, 234.6, 255, 315.01
See application file for complete search history.

(56) References Cited

U.S. PATENT DOCUMENTS 2,859,611 A * 11/1958 Morse ..... F02D 33/003 73/114.38
4,559,815 A * 12/1985 Needham ..... F02M 65/00 73/114.45

(Continued)

FOREIGN PATENT DOCUMENTS

DE 199 45 436 1/2001
EP 2 011 997 1/2009

(Continued)

OTHER PUBLICATIONS

International Search Report, International Application No. PCT/EP2011/062433, dated Oct. 4, 2011.

*Primary Examiner* — Lindsay Low
*Assistant Examiner* — Long T Tran
(74) *Attorney, Agent, or Firm* — Norton Rose Fulbright US LLP

(57) ABSTRACT

A fuel accumulator block is provided for testing high-pressure components of fuel injection devices. The fuel accumulator block includes an accumulator body and at least one pressure control valve, which is accommodated in a receptacle in the accumulator body. The accumulator body is connected to a test line for a test medium and to a cooling line for a cooling medium. Within the accumulator body a test line run is developed for the test medium and a cooling line run is developed for the cooling medium. The cooling line run has at least one section which runs in the vicinity of the receptacle for the pressure control valve.

12 Claims, 3 Drawing Sheets

(56) References Cited

U.S. PATENT DOCUMENTS

| | | | | |
|---|---|---|---|---|
| 4,569,227 | A * | 2/1986 | Adolph | F02M 65/002 73/1.26 |
| 4,788,858 | A * | 12/1988 | Liebermann | F02M 65/001 73/114.48 |
| 5,983,863 | A | 11/1999 | Cavanagh et al. | |
| 6,234,002 | B1 * | 5/2001 | Sisney | F02M 65/001 134/166 R |
| 6,405,712 | B1 | 6/2002 | Nomura | |
| 6,488,011 | B1 * | 12/2002 | Frank | F02M 55/025 123/447 |
| 7,222,613 | B2 * | 5/2007 | Turner | F02M 21/0278 123/27 GE |
| 7,228,729 | B1 * | 6/2007 | Krassinger | F02M 65/00 73/114.42 |
| 7,587,931 | B2 * | 9/2009 | Krassinger | G01F 9/023 73/114.42 |
| 2006/0124112 | A1 * | 6/2006 | Turner | F02M 21/0278 123/516 |
| 2009/0188308 | A1 * | 7/2009 | Krassinger | G01F 9/023 73/114.42 |

FOREIGN PATENT DOCUMENTS

| | | |
|---|---|---|
| JP | 2009 250 069 | 10/2009 |
| WO | WO 2004/018862 | 3/2004 |

* cited by examiner

FUEL ACCUMULATOR BLOCK FOR TESTING HIGH-PRESSURE COMPONENTS OF FUEL INJECTION SYSTEMS

FIELD

The present invention relates to a fuel accumulator block according to the preamble of Claim 1.

BACKGROUND INFORMATION

In auto repair shops, for testing high-pressure components of fuel injection systems of motor vehicles, such as high-pressure pumps or fuel injectors, testing units are used which include a fuel accumulator block as a so-called test rail. The higher the test pressures rise in the testing of the high-pressure components, the higher are the temperatures that occur in the test rail. These temperatures are created both by the compression of the test medium (testing oil) of up to 250 MPa and by the friction taking place at the pressure control valves acting as throttles, as well as by heating by the electromagnetic switching valve of the pressure control valve. To cool pressure control valves in common rail installed in motor vehicles, the pressure control valve has fuel flowing around it, which thereby already generates cooling. However, the main quantity of the fuel flows through the fuel injectors. In the case of increased or reduced demand for fuel, its supply is controlled in the supply area of the fuel. Therefore, its flow through the pressure control valve is limited, so that in this instance explicit cooling becomes necessary.

The cooling of a fuel accumulator block (common rail) of a fuel-injection system used in a motor vehicle is described in German Patent Application No. DE 199 45 436 C1. In that document, the fuel accumulator block, besides the main bore acting as pressure accumulator, has lines running parallel to it for cooling the fuel accumulator block, in which a cooling medium is circulating. In addition, it is provided that one should also guide the recirculating leakage from the fuel injector through a leakage line guided through the high-pressure accumulator block, so that the leakage also cools the fuel accumulator block.

Especially in the testing of high-pressure pumps, the entire conveyed quantity flows through the pressure control valves, whereby a considerably higher heat stress arises in the test rail than in a fuel accumulator block (common rail) installed in a motor vehicle. Thus, for example, at pressures of 200 MPa and through-flows of more than 70 liter per hour, the admissible operating temperatures for the pressure control valves are exceeded, whereby in particular, the O-ring seals of the pressure control valves are endangered. Other components, such as pressure sensors or pressure limiting valves, may fail prematurely because of the higher temperatures. Besides, at increasing temperature, the stability of the fuel accumulator block (test rail) becomes decreased, particularly with respect to a high pressure load.

SUMMARY

An example fuel accumulator block according to the present invention may have the advantage that, because of the cooling of the accumulator body, the temperature-critical places, particularly of the pressure control valves installed in the accumulator body, are exposed to a lower temperature stress, so that their service life is increased. Besides that, by cooling the accumulator body, it is possible further to raise the test pressure for the components without exceeding the admissible temperatures, without bringing on the destruction of the pressure control valves, for example. This means at the same time that the service life of the pressure control valves is increased even at test pressures above 200 MPa. In addition, the pressure load of the fuel accumulator block is increased by the cooling of the accumulator body. Because of the low temperature level of the fuel accumulator block, the operator of the testing device is also protected from possible injury. Furthermore, because of the low temperatures of the test oil, the measuring system is protected.

Effective cooling of the accumulator body is achieved when the section of the cooling line run at least partially surrounds the accommodation for the pressure control valve, such as in a meander shape or a ring shape, e.g., an annular channel or closed channels running in parallel. In the case of a plurality of accommodations for a plurality of pressure control valves it is expedient if the section of the cooling line run runs between two adjacent receptacles.

A particularly efficient cooling of the accumulator body may be achieved if the cooling line run runs in at least two cooling planes that lie one over the other, within the accumulator body, in the first cooling plane a first line section of the cooling line run being situated and in the second cooling plane a second line section of the cooling line run being situated, and the two line sections being connected via at least one rising line.

In this context, besides the two cooling planes, the cooling line run includes a distribution plane in which a first distribution line is situated having an intake opening for accommodating an intake connector for the cooling medium. From the first distribution line, a first rising line leads into the first cooling plane, in which the first line section includes two additional distribution lines. From the first line section, a second rising line leads into the second cooling plane, in which the second line section includes two additional distribution lines. Finally, from one of the additional distribution lines, an output line branches off, which leads to an outlet opening for an outlet connector for connecting the cooling line. The cooling line run may also run within the accumulator body via more than two cooling planes.

Between the distribution lines situated in a cooling plane, cross lines expediently run in each case between the receptacles for the pressure control valves, the distribution lines situated in a cooling plane and the cross lines situated in a cooling plane in each case run parallel to one another.

An exemplary embodiment of the present invention is represented in the figures and explained in greater detail below.

BRIEF DESCRIPTION OF THE DRAWINGS

FIG. 7 shows a 3D view of the accumulator body having the courses of the bores drawn in.

DETAILED DESCRIPTION OF EXAMPLE EMBODIMENTS

Figure 1:
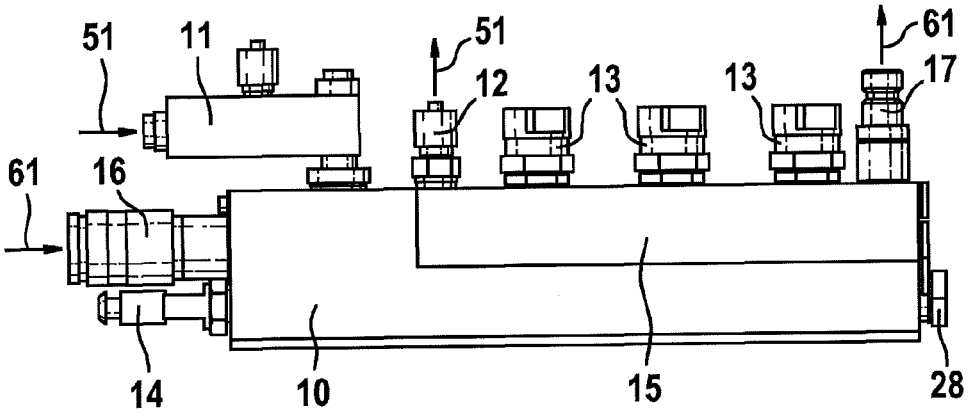
FIG. 1 shows a lateral view of a fuel accumulator block having attachment components.

The fuel accumulator block shown in FIG. 1 includes an accumulator body 10 along with attachment components situated on it, such as an inlet connector 11 and an outlet connector 12 for connecting a test line 51, respectively shown schematically by arrows, for a test medium, such as test oil, an additional inlet connector 16 and an additional outlet connector 17 for connecting a cooling line 61 for circulating cooling medium, respectively shown schematically by arrows. Accumulator body 10 is used as a test rail, for example, for testing high-pressure components of fuel injection systems of motor vehicles, e.g. of high-pressure pumps or fuel injectors.

In accumulator body 10, furthermore, for instance, three pressure control valves 13 for controlling the test pressure as well as a pressure sensor 14 for recording the test pressure are used as attachment components. On accumulator body 10, furthermore, a test oil collector 15 is flange-mounted as an attachment component, into which post-connected outlets open out for discharging a controlled termination quantity of pressure control valves 13.

As a high-pressure component that is to be tested, the high-pressure pump, for example, is connected to inlet connector 11 via test line 51. In this case of application, outlet connector 12 is closed. The test oil, in this case, is guided through pressure control valve 13 into test oil collector 15, and from there to a measuring device (not shown) for volume flow measurement. In the case of a fuel injector that is to be tested, test line 51 goes from outlet connector 12 to a distributor rail (not shown) to which the fuel injector, that is to be tested, is connected.

Figure 2:
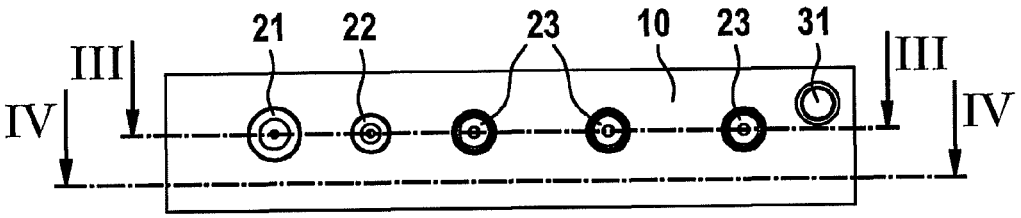
FIG. 2 shows a top view onto an accumulator body of the fuel accumulator block without attachment components.
Figure 3:
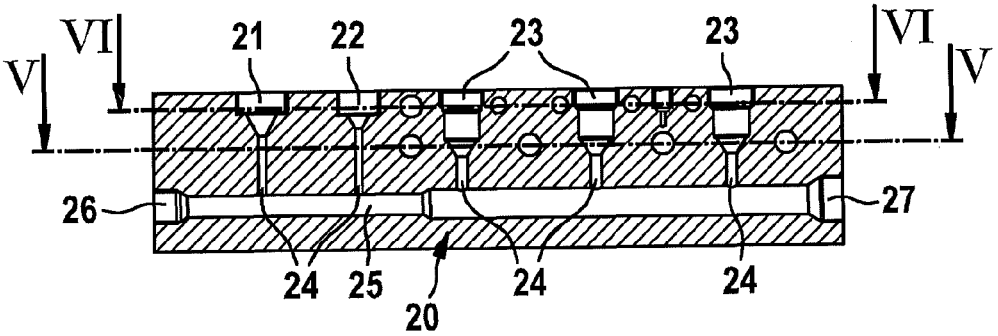
FIG. 3 shows a section through the accumulator body according to line in FIG. 2.

The accumulator body 10 according to FIG. 2 has an inlet connector receptacle 21 for inserting inlet connector 11, an outlet connector receptacle 22 for inserting outlet connector 12 and for inserting pressure control valves 13 a pressure control valves receptacle 23, respectively. Receptacles 21, 22, 23 are integrated into a test line run 20, which, according to FIG. 3, includes a bus line 25 and branch lines 24, branch lines 24 connecting receptacles 21, 22, 23 to bus line 25. Bus line 25 is provided at one end with an opening 26 for inserting pressure sensor 14 and at the opposite end with an additional opening 27 for inserting a blanking plug 28. Bus line 25 is used as a high-pressure accumulator for the test oil that is to be stored in accumulator body 10.

Figure 4:
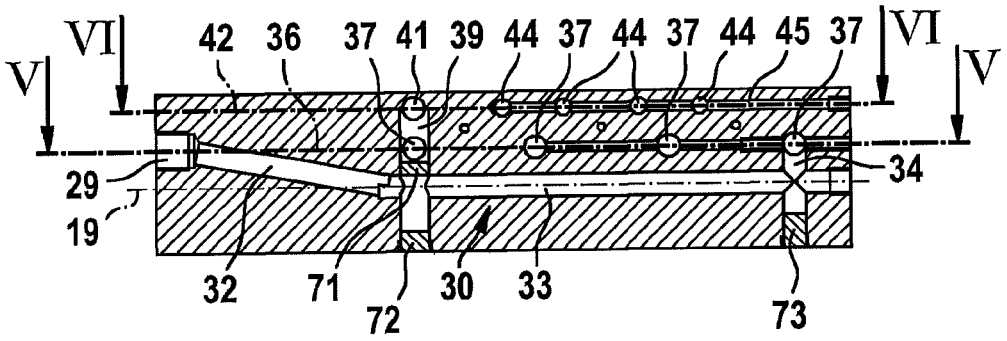
FIG. 4 shows a section through the accumulator body according to line IV-IV in FIG. 2.
Figure 5:
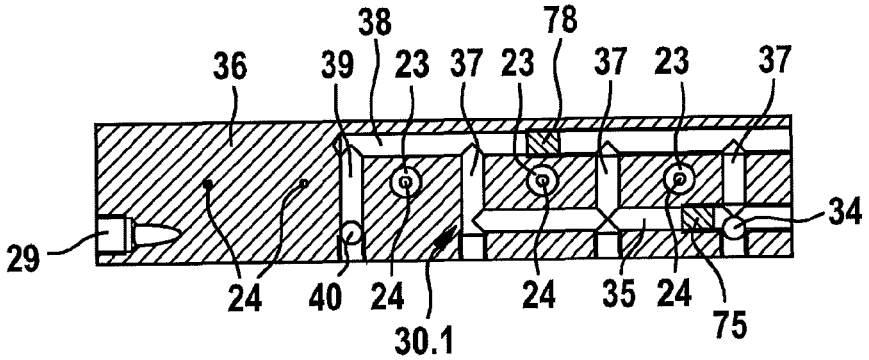
FIG. 5 shows a section through the accumulator body according to line V-V in FIGS. 3 and 4.

According to FIGS. 4 and 5, accumulator body 10 also has, at a lateral end face, an inlet opening 29 for additional inlet connector 16 for cooling line 61, as well as, on the upper side, according to FIG. 2, an outlet opening 31 for additional outlet connector 17 for cooling line 61.

Figure 6:
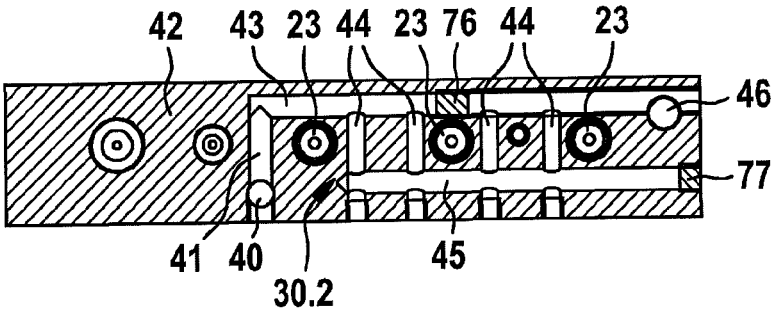
FIG. 6 shows a section through the accumulator body according to line VI-VI in FIGS. 3 and 4.

In FIGS. 4, 5 and 6 one may see a cooling line run 30 for the cooling medium within accumulator body 10. Cooling line run 30 includes a first line section 30.1 in a first cooling plane 36, a second line section 30.2 in a second cooling plane 42 and a non-designated third line section in a distribution plane 19. Cooling line run 30 leads from inlet opening 29 for the additional inlet connector 16 via a slantwise line 32 to a first distribution line 33 in distribution plane 19. At the end of first distribution line 33, a first rising line 34 branches off which leads to a first line section 30.1 in the first cooling plane 36, first cooling plane 36 being represented by FIG. 5. In first cooling plane 36 there are located, running parallel to each other, a second distribution line 35 and a third distribution line 38, as well as between pressure control valve receptacles 23, and also running parallel to one another, three cross lines 37, for example. First rising line 34 leads, in this case, to one of the three cross lines 37, so that via first rising line 34 the connection is produced between first distribution line 33 and first line section 30.1 in first cooling plane 36.

At the end of third distribution line 38, in first cooling plane 36 there is a connecting line 39, running parallel to cross lines 37, from which a second rising line 40 branches off, which leads to second line section 30.2, which is located in second cooling plane 42 lying above it, second cooling plane 42 being shown by FIG. 6. Second rising line 40, in this context, leads from first connecting line 39 in first cooling plane 36 to a second connecting line 41 in second cooling plane 42. The second rising line is executed as a blind bore which is closed at the crossing with first distribution line 33 by using screw plugs 71, 72.

Second connecting line 41, lying in second cooling plane 42, leads to a fourth distribution line 43, from which, for instance, three additional cross lines 44, that run parallel to one another, branch off, which lead to an additional connecting line 45 lying opposite, in parallel to one of fourth distribution line 44. Second connecting line 41 runs parallel to the additional cross lines 44. At the end of fourth distribution line 43, there branches off at right angles an outlet line 46, which leads to outlet opening 31 for additional outlet connector 17, for connecting cooling line 61.

In order for cooling line run 30 in line sections 30.1, 30.2 to lead around receptacles 23 in meander or snake shape, screw plugs 75, 78 are inserted in line section 30.1 into distribution lines 35, 38, and in line section 30.2, screw plugs 76, 77 are inserted into distribution lines 43, 45.

Figure 7:
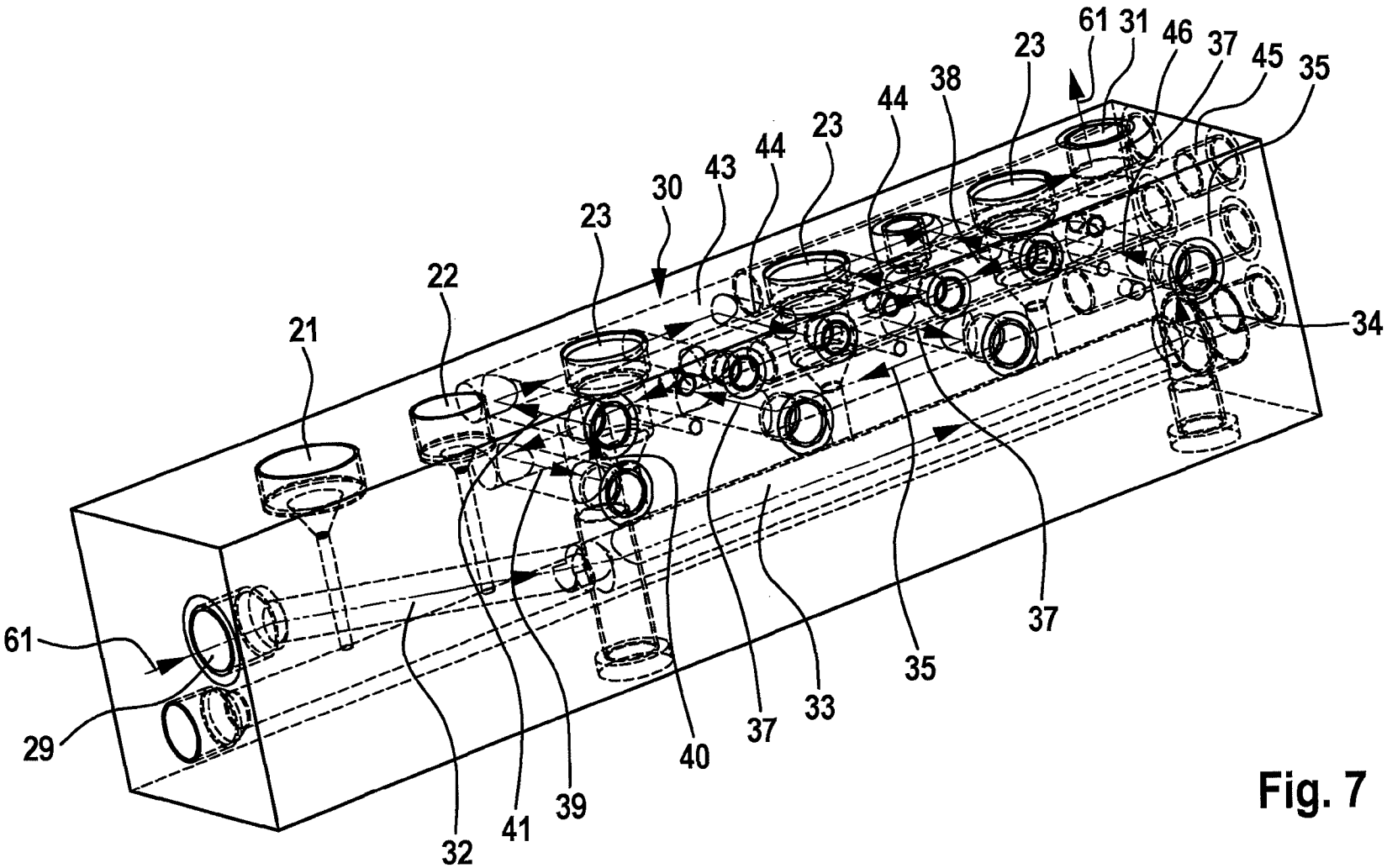

For greater clarity, cooling line run 30 within accumulator body 10 is shown once more in a 3D view in FIG. 7. It may be seen in FIG. 7 that cooling line run 30 within accumulator body 10 is embodied in such a way that the cooling medium is guided through accumulator body 10 in, for instance, the two parallel cooling planes 36 and 42, lying one above the other, by two line sections 30.1 and 30.2 in the vicinity of receptacles 23 for pressure control valves 13. Cooling line run 30 is executed by making bores, which, for the development of the required circulation in distribution plane 19 and the two cooling planes 36, 42, are closed at the bore-through opening using blanking plugs.

Besides the test oil mentioned, water, special glycol mixtures or even air are conceivable as a test medium. It is also possible that, besides cooling line run 30, one might also execute test line run 20 in the vicinity of receptacles 23 for pressure control valves 13, whereby the test medium realizes an additional cooling of pressure control valves 13. With respect to the cooling line run, besides the meander-shaped runs, other runs are also possible in a different number of cooling planes, such as circular runs, for instance annular channels or runs having a plurality of parallel bores.

Accumulator body 10 may also be additionally designed inside to have plates and/or cooling ribs, in order to achieve even better efficiency. As a further alternative, cooling using outer ribs and fans may also be used in addition. A temperature reduction at pressure control valve 13 is also possible by increasing the number of pressure control valves 13 used in accumulator body 10.

What is claimed is:

1. A fuel accumulator block, comprising:

an accumulator body having a receptacle, the accumulator body being connected to a test line for a first medium and to a cooling line for a second medium, wherein the first medium is a test medium and the second medium is a cooling medium;

a pressure control valve situated in the receptacle of the accumulator body; and a test line run for the test medium and a cooling line run for the cooling medium developed within the accumulator body, wherein the cooling line run has at least one section which runs in a vicinity of the receptacle for the pressure control valve, wherein the test line run and the cooling line run are separate runs, wherein the test line run has a first inlet connector and a first outlet connector, and wherein the cooling line run has a second inlet connector and a second outlet connector.

2. The fuel accumulator block as recited in claim 1, wherein the fuel accumulator block is a test rail for testing high pressure components of a fuel injector device.

3. The fuel accumulator block as recited in claim 1, wherein the section at least partially surrounds the receptacle.

4. The fuel accumulator block as recited in claim 1, wherein the section surrounds the receptacle in a meandering shape.

5. The fuel accumulator block as recited in claim 1, wherein the section surrounds the receptacle in an annular shape.

6. The fuel accumulator block as recited in claim 1, wherein a plurality of receptacles are provided in the accumulator body for accommodating a plurality of pressure control valves, and the section runs in at least one plane between two adjacent ones of the plurality of the receptacles.

7. The fuel accumulator block as recited in claim 1, wherein the cooling line run runs in at least two cooling planes, that lie one over the other, within the accumulator body.

8. The fuel accumulator block as recited in claim 7, wherein a first line section of the cooling line run is situated in a first one of the cooling planes and a second line section of the cooling line run is situated in a second one of the cooling planes.

9. The fuel accumulator block as recited in claim 7, wherein the cooling line run runs next to the two cooling planes in a distribution plane, in which a first distribution line is situated having an inlet opening for accommodating an inlet connector for the cooling line.

10. The fuel accumulator block as recited in claim 9, wherein a first rising line leads from the first distribution line into the first cooling plane, in which the first line section includes two additional distribution lines; a second rising line leads from the first line section into the second cooling plane, in which the second line section includes two additional distribution lines; and an output line branches off from one of the additional distribution lines, which leads to an outlet opening for an additional outlet connector for connecting the cooling line.

11. The fuel accumulator block as recited in claim 10, wherein, between the additional distribution lines situated in a cooling plane, in each case cross lines run between the receptacles for the pressure control valves.

12. The fuel accumulator block as recited in claim 11, wherein the additional distribution lines situated in a cooling plane and the cross lines situated in a cooling plane each run parallel to one another.

* * * * *